US010426273B2

(12) United States Patent
Gauvin

(10) Patent No.: US 10,426,273 B2
(45) Date of Patent: Oct. 1, 2019

(54) EXPANDABLE AND COLLAPSIBLE SUPPORT DEVICE AND OPERATING METHODS THEREFOR

(71) Applicant: The Solace Company LLC, Brighton, MI (US)

(72) Inventor: Justin M. Gauvin, Waltham, MA (US)

(73) Assignee: The Solace Company, LLC, Brighton, MI (US)

( * ) Notice: Subject to any disclaimer, the term of this patent is extended or adjusted under 35 U.S.C. 154(b) by 0 days.

(21) Appl. No.: 15/662,463

(22) Filed: Jul. 28, 2017

(65) Prior Publication Data

US 2018/0049557 A1 Feb. 22, 2018

Related U.S. Application Data

(60) Provisional application No. 62/370,877, filed on Aug. 4, 2016.

(51) Int. Cl.

| | |
|---|---|
| ***A47C 19/14*** | (2006.01) |
| ***A47C 19/12*** | (2006.01) |
| ***A47C 17/64*** | (2006.01) |
| ***A47C 1/14*** | (2006.01) |
| ***A47C 13/00*** | (2006.01) |
| ***F41H 5/08*** | (2006.01) |
| ***A47C 4/28*** | (2006.01) |
| ***F41H 3/00*** | (2006.01) |
| ***A45F 3/04*** | (2006.01) |
| *A45F 3/00* | (2006.01) |

(52) U.S. Cl.

CPC ..... *A47C 19/14* (2013.01); *A45F 3/04* (2013.01); *A47C 1/143* (2013.01); *A47C 4/286* (2013.01); *A47C 13/00* (2013.01); *A47C 17/64* (2013.01); *A47C 19/126* (2013.01); *F41H 3/00* (2013.01); *F41H 5/08* (2013.01); *A45F 2003/003* (2013.01)

(58) Field of Classification Search

CPC ..... A47C 17/64; A47C 17/70; A47C 17/72; A47C 17/74; A47C 17/82; A47C 19/005; A47C 19/12; A47C 19/122; A47C 19/126; A47C 19/14

USPC ..... 5/115, 110–114, 116, 117

See application file for complete search history.

(56) References Cited

U.S. PATENT DOCUMENTS

| | | | | | |
|---|---|---|---|---|---|
| 7,712 | A | * | 10/1850 | Whitmarsh | A47C 19/14 5/115 |
| 37,153 | A | * | 12/1862 | Cross | A47C 19/14 5/115 |
| 228,920 | A | * | 6/1880 | Murray et al. | A47C 19/14 5/115 |
| 327,055 | A | * | 9/1885 | Baker | A47C 19/14 5/115 |

(Continued)

FOREIGN PATENT DOCUMENTS

WO WO-2019023708 A2 * 1/2019

*Primary Examiner* — Robert G Santos

(74) *Attorney, Agent, or Firm* — Brooks Kushman P.C.

(57) ABSTRACT

An expandable and collapsible support device for multiple use enables attaining an expanded open state for use or return to a compact closed state in mere seconds. The device includes an accordion-style frame that expands laterally from a compact closed state to an expanded open state for use, and a material support cover forming the top of the device and attachable to the frame to provide a support surface above ground level for the device.

10 Claims, 11 Drawing Sheets

(56) References Cited

U.S. PATENT DOCUMENTS 438,630 A * 10/1890 Lyon ..... A47C 19/126 5/116
540,041 A * 5/1895 Blomberg ..... A47C 19/14 5/115
634,665 A * 10/1899 Holge ..... A47C 19/14 5/115
640,293 A * 1/1900 Freuler ..... A61G 1/013 5/627
665,299 A * 1/1901 Wood ..... A47C 17/68 5/112
694,097 A * 2/1902 Freuler ..... A61G 1/013 5/627
732,755 A * 7/1903 Linden et al. ..... A47C 19/14 5/115
793,723 A * 7/1905 Herman ..... A47C 19/14 5/115
928,317 A * 7/1909 Menten ..... A47C 19/14 5/115
1,151,495 A * 8/1915 Menten ..... A45F 3/22 297/130
1,185,568 A * 5/1916 Zeunert ..... A47B 3/00 108/115
1,237,052 A * 8/1917 Kaplan ..... A47C 19/14 5/115
1,269,641 A * 6/1918 Peterson ..... A47C 19/14 5/115
1,287,286 A * 12/1918 Gannon ..... A47C 19/14 5/115
1,330,901 A * 2/1920 Richards ..... A47C 19/126 5/115
1,420,126 A * 6/1922 Morfoot ..... A47C 19/126 5/112
1,439,272 A * 12/1922 Smith ..... A47C 19/126 5/115
1,483,979 A * 2/1924 Luery ..... A47C 19/126 16/366
1,540,212 A * 6/1925 Gannon ..... A47C 19/126 5/115
1,577,205 A * 3/1926 Davis ..... A47C 19/122 5/112
1,758,721 A 5/1930 Swartz et al.
1,788,919 A 1/1931 Lansberry et al.
2,024,170 A 12/1935 Kruse
2,203,193 A * 6/1940 Ettinger ..... A47C 19/126 5/111
2,394,981 A * 2/1946 Calder ..... A47C 17/64 5/117
2,973,888 A 3/1961 Beardsley
3,137,511 A 6/1964 Weil et al.
D207,302 S 4/1967 Lerner
3,589,715 A 6/1971 Mark et al.
3,730,407 A 5/1973 Russell
3,822,422 A 7/1974 Buntyn
4,392,598 A 7/1983 Dixon
4,846,204 A * 7/1989 Sok Kyu ..... E04H 15/324 5/113
4,860,393 A 8/1989 Schefthaler
D407,575 S 4/1999 Meoli, Jr.
6,134,727 A * 10/2000 Hwang ..... A47C 17/64 5/110
6,202,907 B1 3/2001 Higgins
6,364,410 B1 * 4/2002 Tang ..... A47C 4/286 297/16.2
6,446,282 B1 * 9/2002 Wu ..... A47C 17/645 5/115
6,457,192 B2 * 10/2002 Choi ..... A47C 4/286 5/112
6,564,402 B1 * 5/2003 Lin ..... A47C 17/645 24/72.5
6,581,223 B1 * 6/2003 Wang ..... A47C 17/72 5/111
6,651,853 B2 11/2003 Higgins et al.
6,711,761 B2 * 3/2004 Choi ..... A47C 4/286 5/112
6,763,534 B2 * 7/2004 Hwang ..... A47C 7/62 5/110
6,925,664 B1 * 8/2005 Twigg ..... A01K 1/034 5/112
7,100,221 B1 * 9/2006 Twigg ..... A01K 1/034 5/110
7,114,205 B2 * 10/2006 Choi ..... A47C 4/286 5/114
7,509,695 B2 * 3/2009 Zheng ..... A47C 17/68 273/108
7,636,962 B2 * 12/2009 Zheng ..... A47C 17/68 5/112
7,681,267 B1 * 3/2010 Hall ..... A47D 5/006 5/115
7,712,163 B2 * 5/2010 Flannery ..... A47C 17/72 5/110
7,757,314 B2 * 7/2010 Yul ..... A47C 19/14 5/110
7,770,246 B2 * 8/2010 Chen ..... A47C 19/126 5/111
7,950,083 B2 * 5/2011 Flannery ..... A47C 17/72 5/110
7,959,222 B1 6/2011 Powell et al.
8,245,332 B2 * 8/2012 Yul ..... A47C 17/16 5/111
8,256,042 B2 * 9/2012 Yul ..... A47C 17/72 5/110
8,393,023 B2 3/2013 Choi
8,959,677 B2 * 2/2015 Yul ..... A47C 17/64 5/110
9,131,778 B2 9/2015 Jin et al.
9,756,950 B2 * 9/2017 Choi ..... A47C 19/126
2001/0054198 A1 * 12/2001 Choi ..... A47C 4/286 5/114
2003/0019033 A1 * 1/2003 Choi ..... A47C 4/286 5/114
2004/0000009 A1 * 1/2004 Choi ..... A47C 4/286 5/174
2004/0034929 A1 * 2/2004 Hwang ..... A47C 7/62 5/114
2006/0174415 A1 8/2006 Moulton
2008/0127413 A1 * 6/2008 Flannery ..... A47C 17/72 5/111
2008/0189855 A1 * 8/2008 Zheng ..... A47C 17/68 5/116
2008/0196162 A1 * 8/2008 Yul ..... A47C 19/126 5/97
2008/0214332 A1 * 9/2008 Zheng ..... A47C 17/68 473/476
2008/0216230 A1 * 9/2008 Yul ..... A47C 17/64 5/12.2
2008/0295246 A1 * 12/2008 Yul ..... A47C 17/16 5/12.2
2009/0139026 A1 * 6/2009 Chen ..... A47C 17/72 5/111
2009/0178196 A1 * 7/2009 Zheng ..... A47C 17/68 5/111
2009/0249546 A1 * 10/2009 Yul ..... A47C 17/72 5/115
2010/0223723 A1 * 9/2010 Flannery ..... A47C 17/72 5/111
2016/0150889 A1 * 6/2016 Choi ..... A47C 19/126 5/111
2018/0049557 A1 * 2/2018 Gauvin ..... A47C 17/64

* cited by examiner

EXPANDABLE AND COLLAPSIBLE SUPPORT DEVICE AND OPERATING METHODS THEREFOR

CROSS-REFERENCE TO RELATED APPLICATION

The present application claims the benefit under 35 U.S.C. § 119(e) of U.S. Provisional Patent Application No. 62/370,877 to Justin Michael Gauvin, filed Aug. 4, 2017, the entire contents of which is hereby incorporated by reference herein.

BACKGROUND

Field

The example embodiments in general are directed to an expandable and collapsible support device and operating methods therefor.

Related Art

Combination support devices such as cot and lounge chair apparatuses for camping and recreational activities are widely prevalent today, with many being offered commercially online at web sites such as BACKCOUNTRY®, MOOSEJAW®, and SIERRA TRADING POST®, or available both online and in national retail chains such as art REI®, DICK'S® SPORTING GOODS, SPORT AUTHORITY®, MODELL'S®, GANDER MOUNTAIN®, CABELA'S®, BASS PRO SHOPS®, and the like. Many of these websites and stores have convertible cots, chairs, or both.

However, in some instances these apparatuses require installation or multiple steps in order to open the apparatus for use, or to break the apparatus down for storage and travel, which can be time-consuming. Additionally, many of these apparatuses are rather bulky and as such cannot be compacted into a small foot print for ease of storage and travel. Accordingly, what is needed is an expandable and collapsible support device for multipurpose use that can be expanded or collapsed in mere seconds for use or storage.

SUMMARY

An example embodiment of the present invention is directed to an expandable and collapsible support device. The device includes an accordion-style frame that expands laterally from a compact closed state to an expanded open state. The frame further includes a plurality of support bars adapted to support the device, in the expanded open state, on a ground surface in adjacent relation to one another and arranged in a width-wise direction of the device, the support bars laterally extendible and collapsible along a lengthwise plane of the device, and a plurality of slider arms in adjacent relation to one another and extendible and collapsible along the lengthwise plane on either side of the device. The frame further includes two sets of scissor arms, each scissor arm set connected across the slider arms and arranged on either lengthwise side of the device, each scissor arm set laterally extensible and collapsible along the lengthwise plane of the device, and a hinge assembly connecting ends of each support bar to a corresponding slider arm to enable pivoting of each slider arm relative to its connected support bar, in going from the compact closed state toward the expanded open state, so that in the expanded open state the slider arm is at an obtuse angle relative to its corresponding support bar, and to enable pivoting of the slider arms inward towards the support bars as the frame is collapsed back into its compact closed state. The device further includes a material support cover to provide a support surface above ground level for the device.

Another example embodiment is directed to an expandable and collapsible support device. The device includes an accordion-style frame that expands laterally from a compact closed state in which no dimension thereof exceeds 21 inches to an expanded open state in which a length of the frame is adapted to exceed 3 feet, and a material support cover forming the top of the device and attachable to the frame to provide a support surface above ground level for the device.

Another example embodiment is directed to a method of operating an accordion-style support device laterally between a compact closed and expanded open states, the device including an expandable and collapsible frame having bottom supports, sets of scissor arms, pivotable arms attached to both the scissor arms sets and the bottom supports, the frame requiring no installation. The method includes rotating, with the device on a support surface, the pivotable arms outward relative to the bottom supports, and lifting the frame up vertically from one end so that the sets of scissor arms expand under gravity and the pivotable arms attain an obtuse angle relative to the bottom supports. The method further includes laying out the expanded frame onto a ground surface to achieve the expanded open state.

BRIEF DESCRIPTION OF THE DRAWINGS

Example embodiments will become more fully understood from the detailed description given herein below and the accompanying drawings, wherein like elements are represented by like reference numerals, which are given by way of illustration only and thus are not limitative of the example embodiments herein.

DETAILED DESCRIPTION

Figure 1:
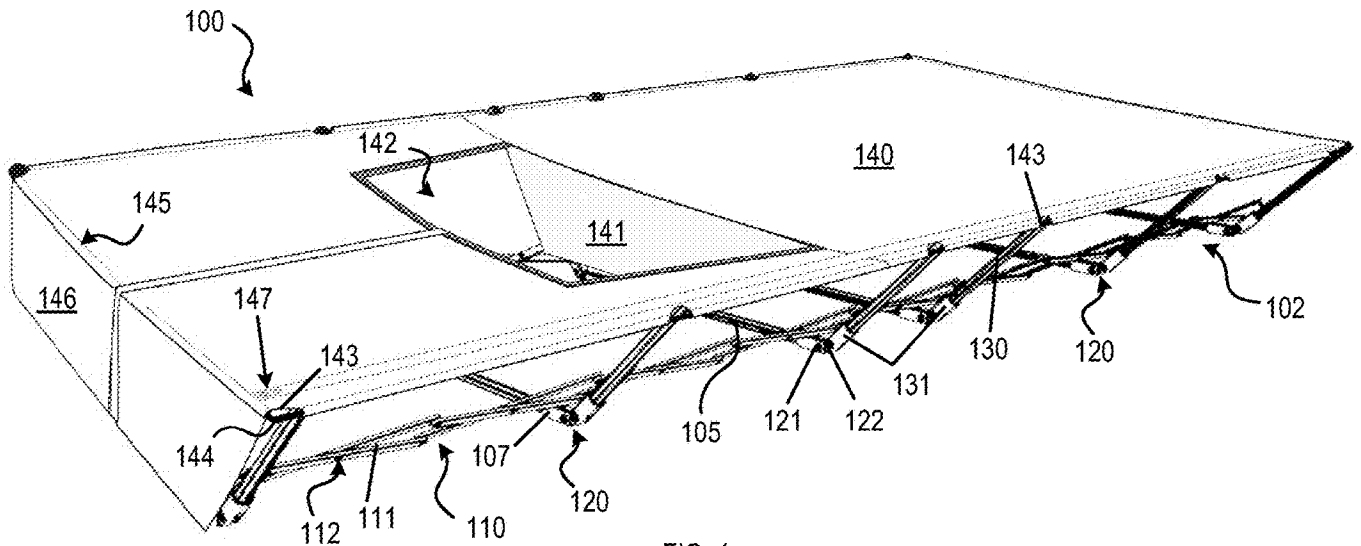
FIG. 1 is a perspective view of an expandable and collapsible support device in a fully expanded open state, according to an example embodiment.

As to be described in detail hereafter, the example embodiments introduce an expandable and collapsible support device which includes an accordion-style frame that expands laterally from a compact closed state to an expanded open state, and a material support cover attached or attachable to the frame to provide a support surface above ground level for the device. The example embodiments also introduce operating methods to quickly open, from a compact closed state, and quickly close, to a compact state from an expended open state, the device in mere seconds.

In the following description, certain specific details are set forth in order to provide a thorough understanding of various example embodiments of the disclosure. However, one skilled in the art will understand that the disclosure may be practiced without these specific details. In other instances, well-known structures associated with manufacturing techniques have not been described in detail to avoid unnecessarily obscuring the descriptions of the example embodiments of the present disclosure.

Unless the context requires otherwise, throughout the specification and claims that follow, the word "comprise" and variations thereof, such as "comprises" and "comprising," are to be construed in an open, inclusive sense, that is, as "including, but not limited to."

Reference throughout this specification to "one example embodiment" or "an embodiment" means that a particular feature, structure or characteristic described in connection with the embodiment is included in at least one embodiment. Thus, the appearances of the phrases "in one example embodiment" or "in an embodiment" in various places throughout this specification are not necessarily all referring to the same embodiment. Further, the particular features, structures or characteristics may be combined in any suitable manner in one or more example embodiments.

As used in this specification and the appended claims, the singular forms "a," "an," and "the" include plural referents unless the content clearly dictates otherwise. The term "or" is generally employed in its sense including "and/or" unless the content clearly dictates otherwise.

As used in the specification and appended claims, the terms "correspond," "corresponds," and "corresponding" are intended to describe a ratio of or a similarity between referenced objects. The use of "correspond" or one of its forms should not be construed to mean the exact shape or size. In the drawings, identical reference numbers identify similar elements or acts. The size and relative positions of elements in the drawings are not necessarily drawn to scale.

Figure 2:
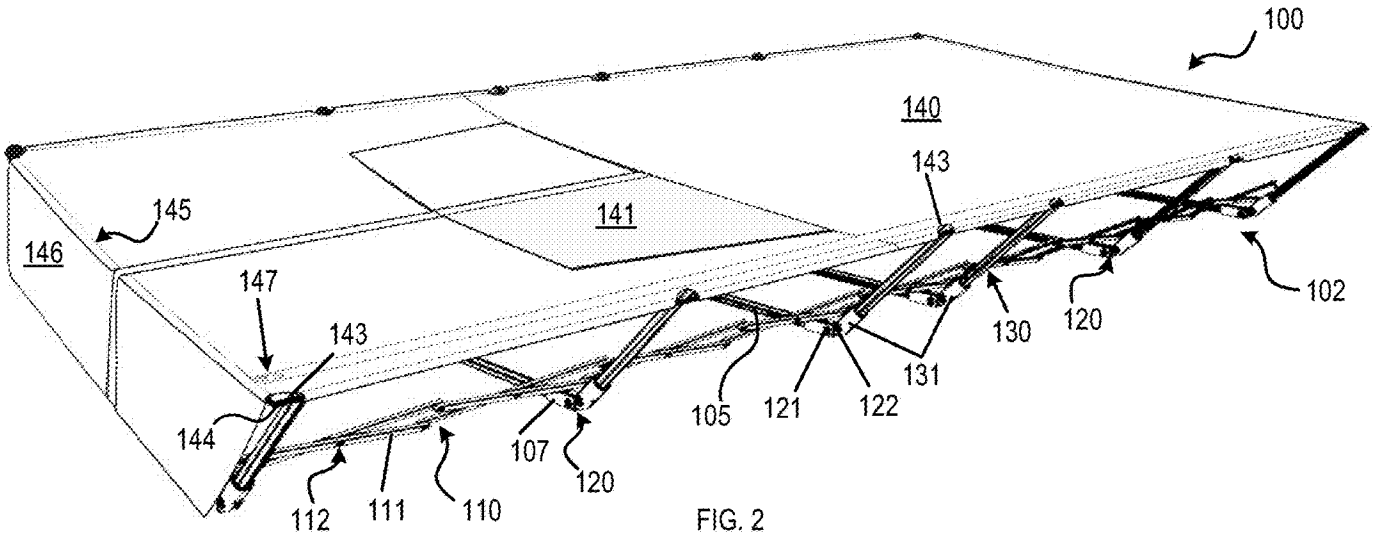
FIG. 2 is a perspective view of the device of FIG. 1 showing the flap compartment in a closed state.

Referring now to FIGS. 1 through 11, there is shown an expandable and collapsible support device 100 according to an example embodiment. Device 100 in FIGS. 1 and 2 is shown in a fully-expanded open sate, and includes an accordion-style frame 102 that expands laterally from a compact closed state to an expanded open state, and a material support cover 140 to provide a support surface above ground level for the device 100. Support cover 140 may be one or multi-piece construction, and can be fixedly attached or removably attached to the frame 102 of device 100. FIGS. 1 and 2 illustrate a two-piece removably attachable construction in which a thin connector piece is connected via zipper 147 to a larger sheet of cover 140. Here, cover 140 has a series of cutouts that engage around upper ends of slider arms 130. A cord or line material, such as a paracord rope or elastic band, could be woven along a periphery (see element 145) and portions 144 can be exposed at cutouts 143 so as to be captured by or otherwise attached to the upper ends of slider arms 130. This is only one example fastening means, others such as hook-an-loop, ties, hooks, tubing, telescoping tubing, fasteners, etc., are foreseeable to the skilled artisan.

Figure 3:
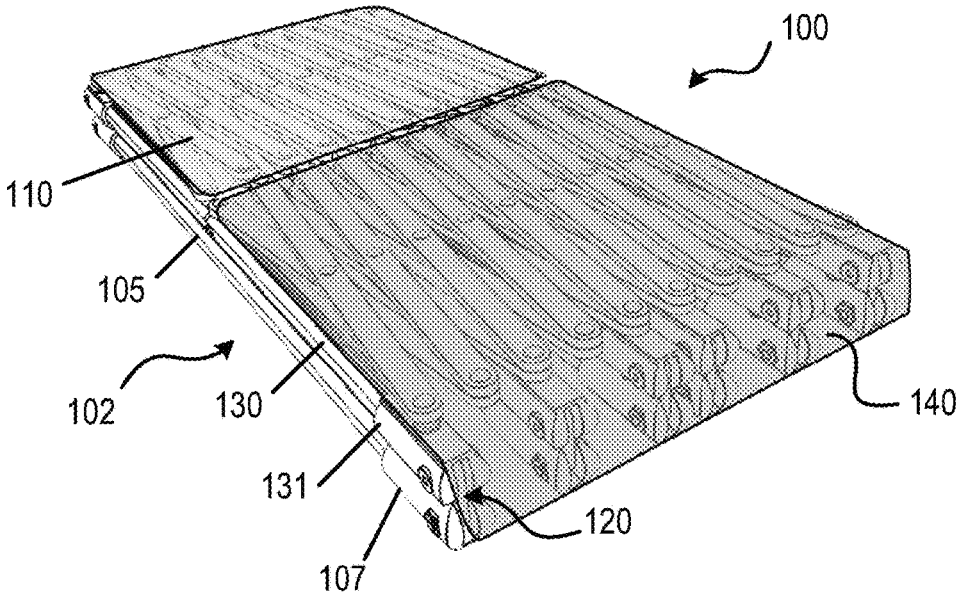
FIG. 3 is a top plan view of the device of FIG. 1 and a compact closed state.
Figure 4:
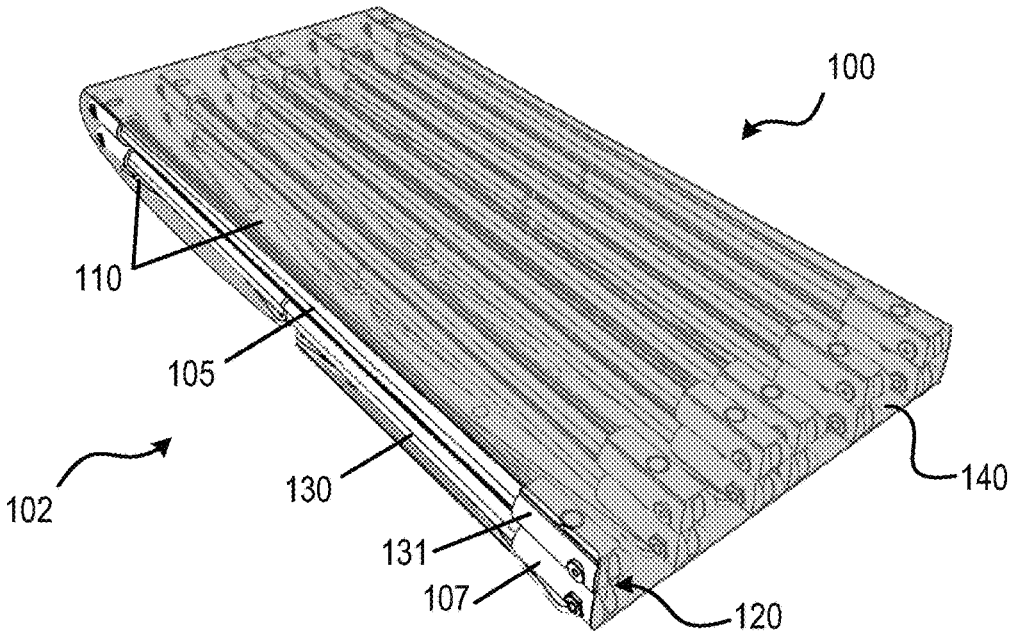
FIG. 4 is a bottom plan view of the device in the compact closed state.
Figure 10:
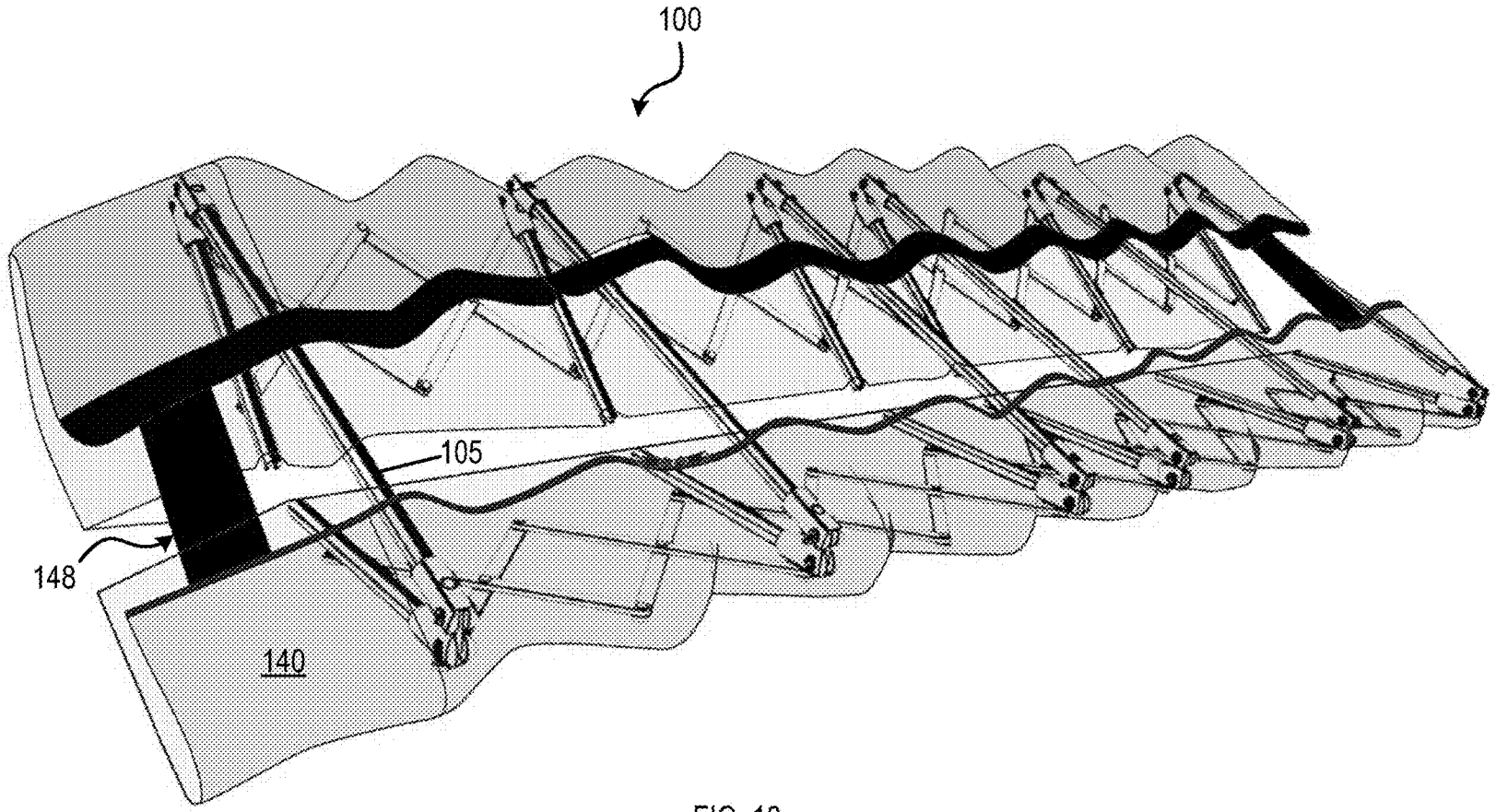
FIG. 10 is a perspective view of the device with the material support cover attached to the frame thereof according to another example embodiment.

FIGS. 3 and 4 show device 100 in the compact closed state and illustrate where cover 140 (in either a single or multi-piece construction) may be fixedly attached to the frame 102 of device 100. FIG. 10 illustrates yet another variant in which cover 140 includes elastic bands 148 that allow it to connect the one or multi-piece construction of support cover 140, and be placed over the slider arms 130 and captured beneath the support arms 105.

Frame 102 further comprises a plurality of support bars 105. Support bars 105 as shown are adapted to support the device 100 on a ground or planar surface, in the expanded open state, in adjacent relation to one another and arranged in a width-wise direction of the device 100. The support bars 105 are thus laterally extendible and collapsible along a lengthwise plane of the device 100.

Figure 11:
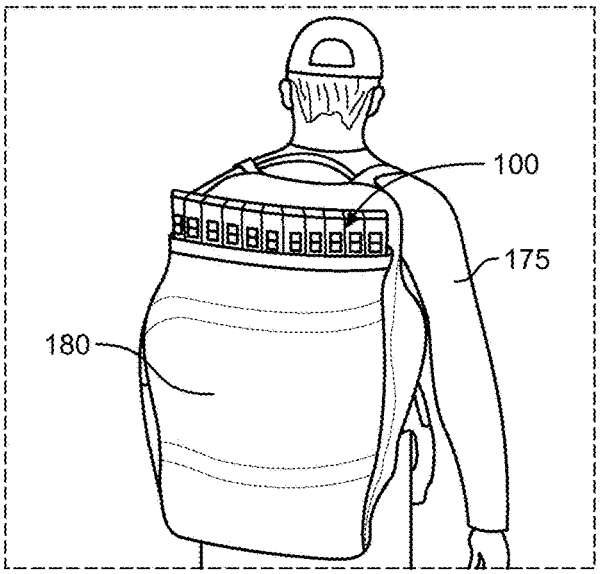
FIG. 11 is a rear view of a person carrying the device in its compact closed state in a backpack.

Device 100 can be configured into any dimensions in both its closed and open states. In one example, and in its compact state, no dimension of the device 100 exceeds 20 inches in length, with a length of 21 inches or less, a width of 10 inches or less, and a height less than 2.1 inches. Of course applications may dictate larger or smaller configurations, it being understood that the compact state dimensions of device 100 lend it to ease of storage and transport. As an example, FIG. 11 is a rear view of a person 175 carrying the device 100 in its compact closed state as a backpack 180. As such, device 100 in its closed compact state is storable as a backpack, within any of a backpack enclosure, suitcase, sack and travel bag, attachable to any of a backpack enclosure, suitcase and travel bag, or stackable in multiples on a movable transport medium or within a container.

Frame 102 also provides a plurality of slider arms 130 in adjacent relation to one another and extendible and collapsible along the lengthwise plane on each side of the device 100, and two sets of scissor arms 110. Each scissor arm set 110 is connected across the slider arms 130 and arranged on either lengthwise side of the device 110. Each scissor arm set 110 is also thus laterally extensible and collapsible along the lengthwise plane of the device 110. Further, each scissor arm set 110 is extendable and collapsible in a plane that is perpendicular to the widthwise extension of the support bars 105 (see best in FIGS. 8 and 9).

Figure 8:
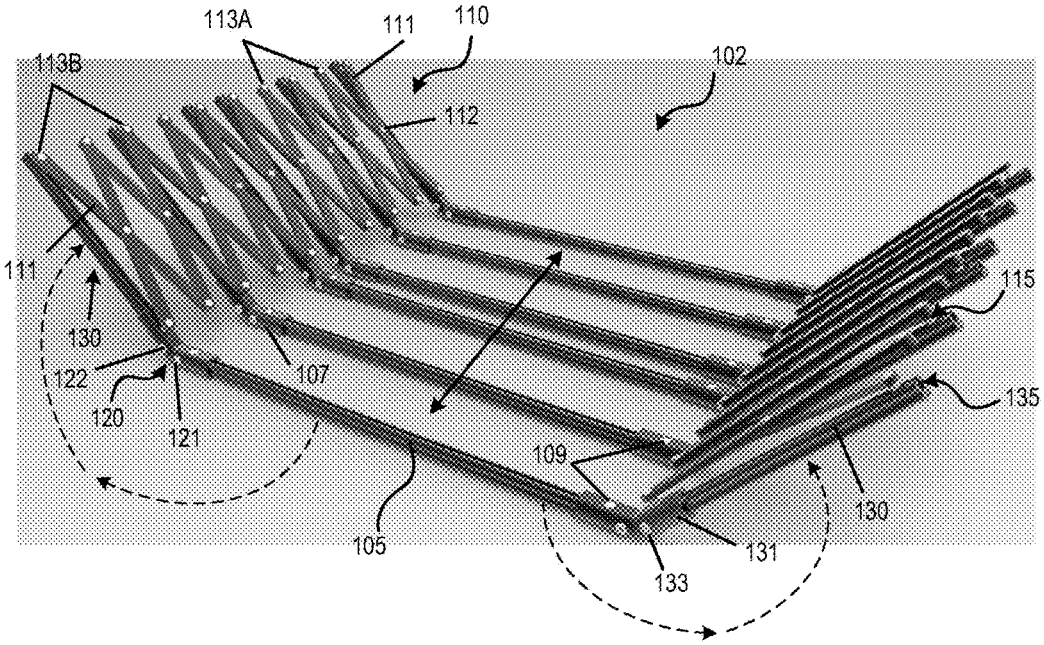
FIG. 8 is a perspective view of the frame for the device of FIG. 1, shown in a partially opened state.
Figure 9:
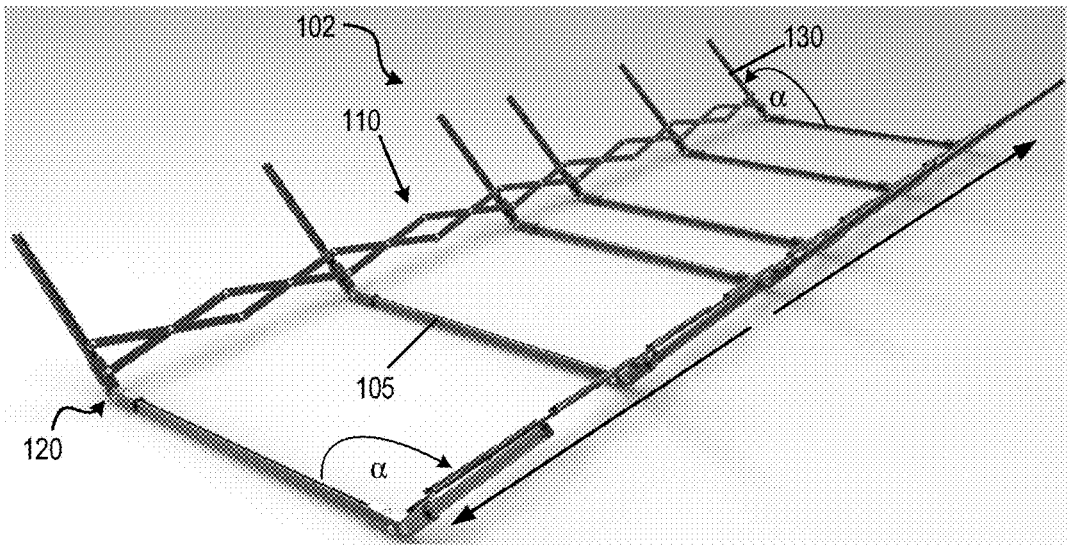
FIG. 9 is a perspective view of the frame for the device of FIG. 1, shown in the fully expanded open state.

Referring to FIG. 8, each scissor arm set 110 is connected at multiple points to each of the corresponding slider arms 130 on its respective lengthwise side of the device 100. The scissor arm set 110 includes a plurality of interconnected segments 111, with pivot connections centrally (at 112), at ends (113A) and at ends 113B that are connected to slider arms 130. For the segment 111 to slider arm 130 connect, the segment is provided with a dowel 115 that is captured in a recess 135 in the slider arm 130; this is merely one example fastening means, others are contemplated within the ordinary skill in the art.

Frame 102 further includes a hinge assembly 120 provided at each interface between an end of a support bar 105 and slide arm 130. Each hinge assembly 120 enables pivoting of its correspondingly connected slider arm 130 relative to its connected support bar 105, in going from the compact closed state toward the expanded open state, so that in the expanded open state the slider arm 130 is at an obtuse angle a (see best in FIGS. 7 and 9) relative to its corresponding support bar 105. Each hinge assembly 120 conversely enables pivoting of the slider arms 130 inward towards the support bars 105 as the frame 102 is collapsed back into its compact closed state; this is merely one hinge assembly example, others are contemplated within the ordinary skill in the art.

In another example, one, some or all of the support bars 105, scissor arm sets 110, hinge assemblies 120, slider arms 130 and constituent parts thereof may be formed of a metal such as steel, Al and/or alloys of steel or aluminum using various know metalworking processes. These processes include but are not limited to CNC machining, sand casting, permanent mold casting, die casting, investment casting, ablation casting, closed-die forging, by extrusion, by cold heading, by stamping & deep drawing, via a screw machine, and through powder metallurgy, for example.

Alternatively, one, some or all of the support bars 105, scissor arm sets 110, hinge assemblies 120, slider arms 130 and constituent parts thereof may be constructed primarily from lightweight moldable plastic materials such as moldable plastic, e.g., as a single or multiple parts formed by an injection molding process using a high impact plastic such as Acrylonitrile Butadiene Styrene (ABS). ABS is an easily machined, tough, low cost rigid thermoplastic material with high impact strength, and may be a desirable material for turning, drilling, milling, sawing, die-cutting, shearing, etc. Virgin ABS may be mixed with a plastic regrind of ABS or another lightweight, durable plastic material. ABS is merely an example material, equivalent materials may include various thermoplastic and thermoset materials, such as plastic reinforced with glass filled nylon (GFN), talc-filled polypropylene, high strength polycarbonates such as GE Lexan®, or blended plastics. There are many known injection molding machines for forming plastic injection molds, other plastic molding processes such as vacuum forming may be used.

Material support cover 140 may be formed of any suitable material, including but not limited to canvas, vinyl, ripstop nylon, nylon, 1,000 Denier Dupont Cordura Nylon, polypropylene/polyurethane blends, lycra, natural or synthetic fabrics laminated or coated with waterproofing materials such as rubber, polyvinyl chloride (PVC), polyurethane, silicone elastomer, fluoropolymers, wax, and the like, or formed out of a GORTEX® material.

The support cover 140 further includes a closeable flap attachment 141 that when open provides a central compartment 142 in the support cover 140. In an example, the central compartment 142 may be configurable to place a person's legs therein, personal articles therein for access therethrough by the person as the person is supported on the device, and to permit access to personal items such as a backpack enclosure, suitcase, sack and travel bag, and to permit access to power cords attached to remote power sources for powering the person's electronic devices.

As best shown in FIGS. 1 and 2, device 100 is further configurable as a cot for sleeping; however it may also be configurable as a lounge chair for seating, as to be shown in subsequent figures. Alternatively, the support cover 140, with the device 100 in its expanded open state, may be further configurable as a camouflage shield or as a ballistic or bullet-proof shield for military and law enforcement use.

As a ballistic shield, cover 140 would be specifically designed to protect against handgun, long gun, and shotgun projectile threats, most types of stabbing or cutting-type weaponry, and hand-thrown or launched projectiles such as rocks and arrows. In use, the shooter would simply prop the device 100 on its side, providing up to 6+ feet in length and at least 2.5 feet in height protection, with shooting lanes provided through center compartment 142, along a side, or through additional viewing apertures provide in cover 140.

The materials of the ballistic shield would be in compliance with specific government ballistic protection levels, such as those promulgated by the United States National Institute of Justice (NIJ) ballistic materials test protocol NIJ-Std-0108.01, for example. Suitable materials for support cover 140 as a ballistic or waterproof shield include but are not limited to armor materials used in one or more wearable or shield products manufactured of KEVLAR®, TWARON® by AKZO®, HONEYWELL® ballistic armoring products such as SPECTRA SHIELD®, GOLD FLEX®, and GOLD SHIELD®, DYNEEMA® fibers made from Ultra High Molecular Weight Polyethylene (UHMWPE), from DSM DYNEEMA®, and the like.

Still further, many multi-purpose uses for support device 100 are envisioned. In its expanded open state, these include but are not limited to one or more of a support surface for supporting items or equipment thereon, a screen backing for viewing video, a foldable display device electrically or wirelessly connected to a computing device, a foldable solar array, a bed for pets or children, a bridge for portaging, a photography backdrop, an outdoor object tossing gaming device and a ladder for climbing.

Figure 5:
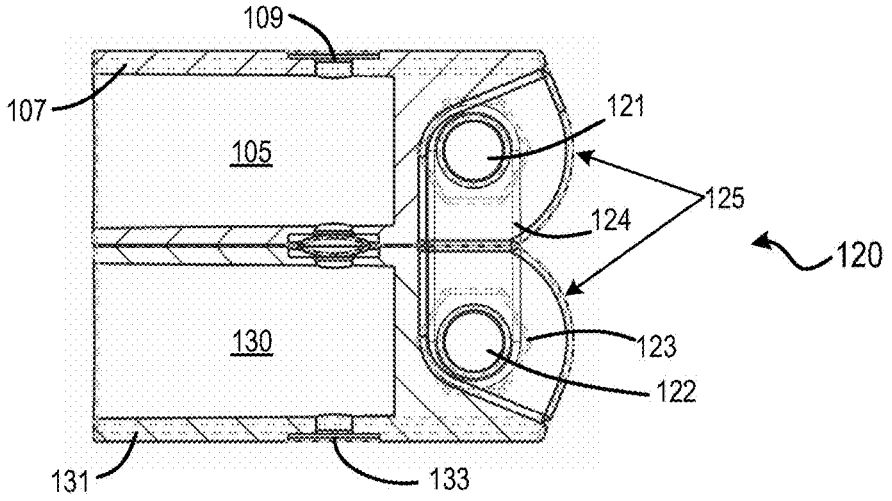
FIG. 5 is a cross-sectional, portioned view of the hinge assembly connecting support bar to the slider bar for the device of FIG. 1, shown in the compact closed state.
Figure 6:
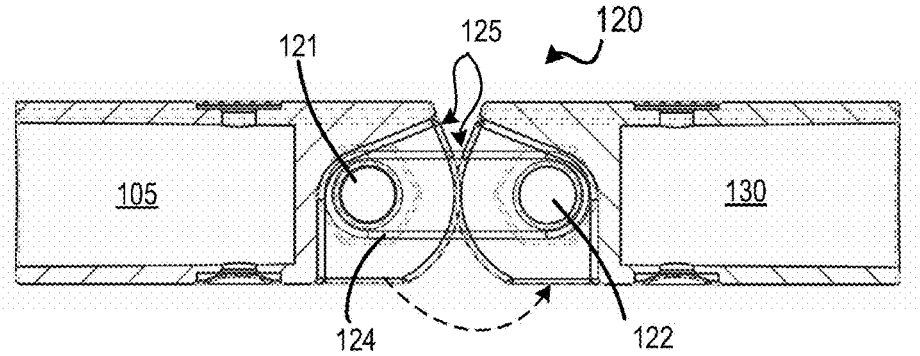
FIG. 6 is a cross-sectional, portioned view of the hinge assembly of FIG. 5, shown in a partially opened state.
Figure 7:
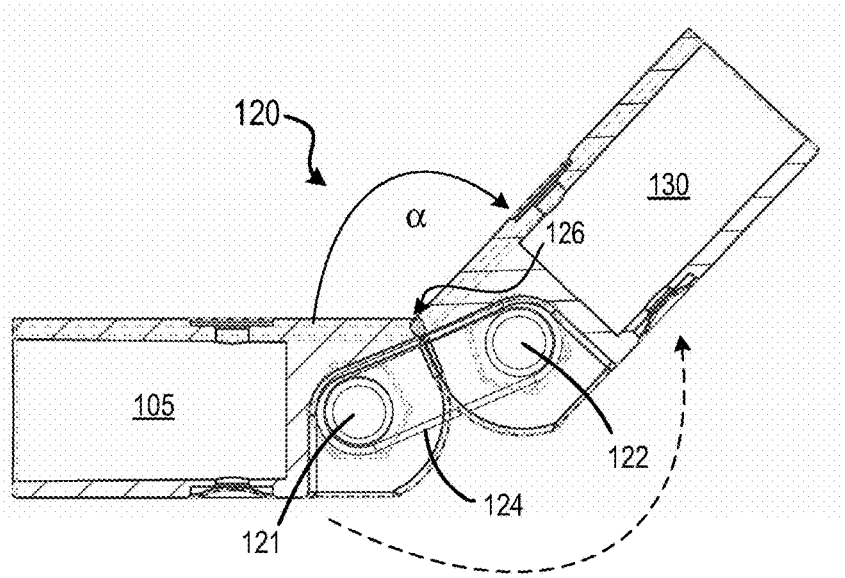
FIG. 7 is a cross-sectional, portioned view of the hinge assembly of FIG. 5, shown in a fully expanded open state.

FIGS. 5 through 7 are provided to illustrate the structure and operation of the hinge assembly 120 in more detail. In these figures, the scissor arms sets 110 have been omitted for purposes of clarity, and the views illustrate a cross-section cut take at the interface between support bar 105 and slider arm 130. As shown, each end of a support bar 105 is attached to a support bar collar 107 and secured by fasteners 109, and the lower end of each slider arm 130 is attached to a slider collar 131 and secured by fasteners 133. FIG. 5 shows the closed state, FIG. 6 a partially-open state, and FIG. 7 the fully-expanded open state.

The hinge assembly 120 is contained within the support bar collar 107 and slider collar 131, and includes a first dowel 121 extending transverse through a distal end of the support bar collar 107, with outer surface of the support bar collar 107 having a curved or beveled surface 125. Hinge assembly 120 also includes a second dowel 122 extending transverse through a distal end of the slider collar 131, an outer surface having a curved or beveled surface 125 as well. A metal or hard plastic linking element 124 attaches the first and second dowels 121, 122 together. Observing the dotted arrows in FIGS. 6 and 7, the linking element 124 and beveled surfaces 125 provide a pivot moment about which the slider arm 130 is pivotable relative to the support bar 105, as the device 100 transitions from the compact closed state to the expanded open state, so as to reach the obtuse angle α (FIG. 7) and vice versa to the compact closed state. A limit stop (at element 126) location prevents further rotation, toward the expanded open state, of the slider arm 130 relative to the support bar 105. For the close to open state, the rotation angle of the slider arm 130 (dotted arrows) is up to almost 270 degrees. Depending on the curvature of surfaces 125 and the tension in linking element 124, the obtuse angle a on the opposite side of the rotation side of slider arm 130 can be set anywhere from slightly greater than 90 degrees to almost 180 degrees; one example setting may be at 135 degrees, such as is shown in FIG. 7.

Figure 12:
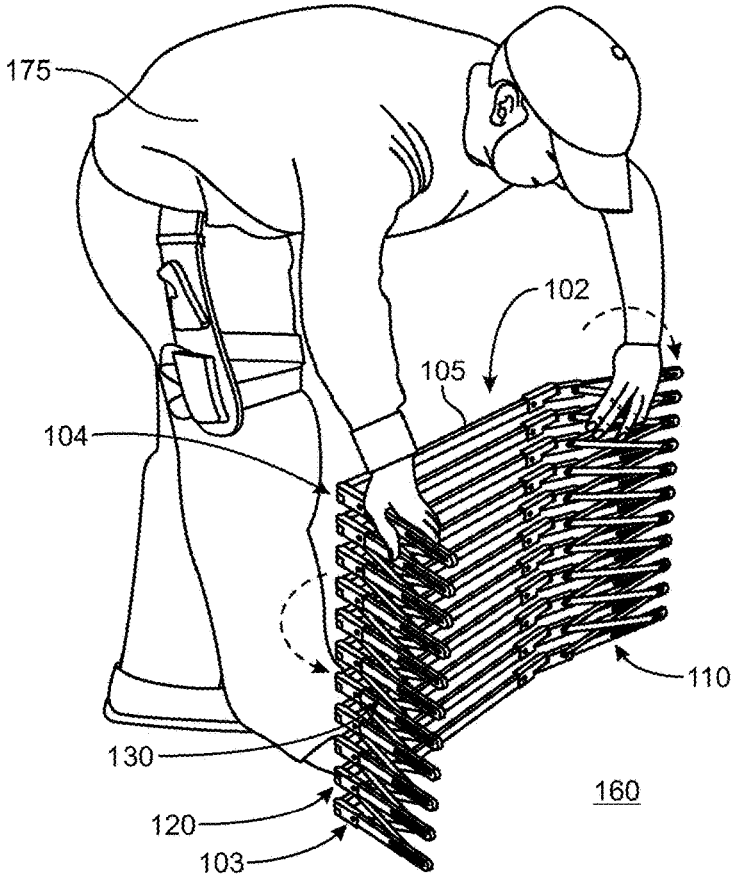
FIG. 12 is a view illustrating one step in a method of opening the device from the compact closed state to the expanded open state according to the example embodiments.
Figure 13:
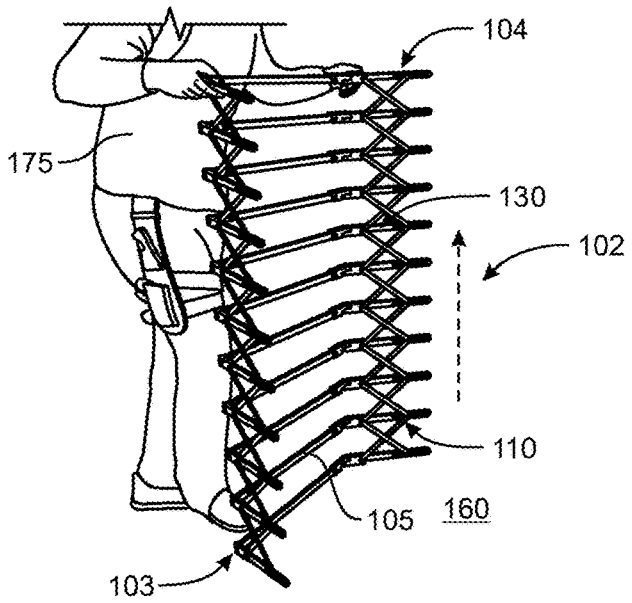
FIG. 13 is a view illustrating another step in the method of opening the device.
Figure 14:
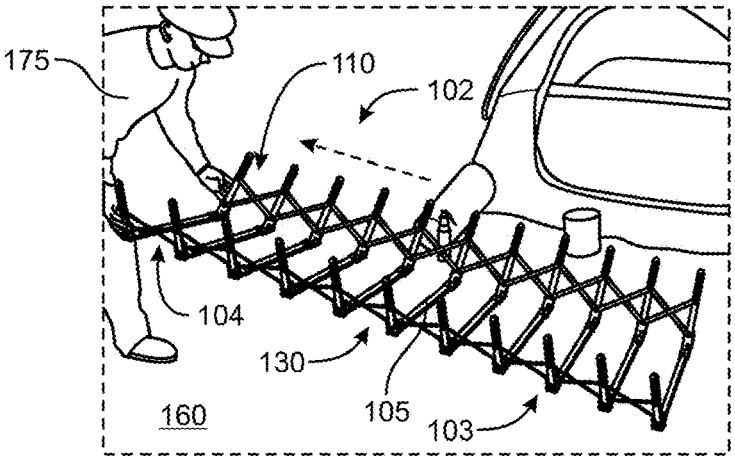
FIG. 14 is a view illustrating a further step in the method of opening the device.
Figure 15:
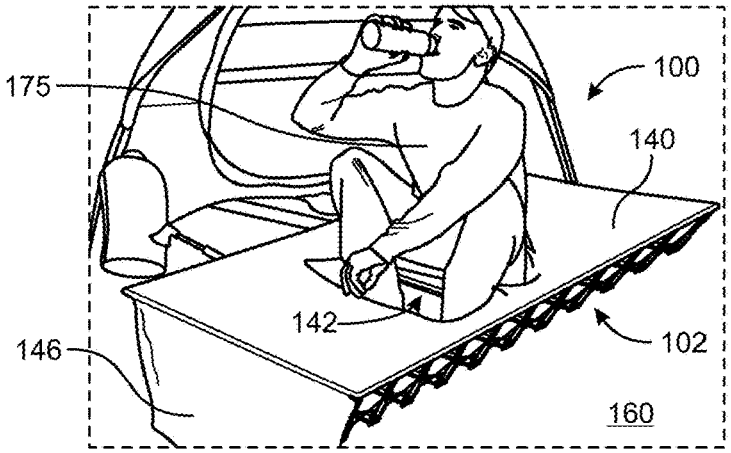
FIG. 15 is a view illustrating an example camping use case for the device in its expanded open state showing the flap compartment open.
Figure 16:
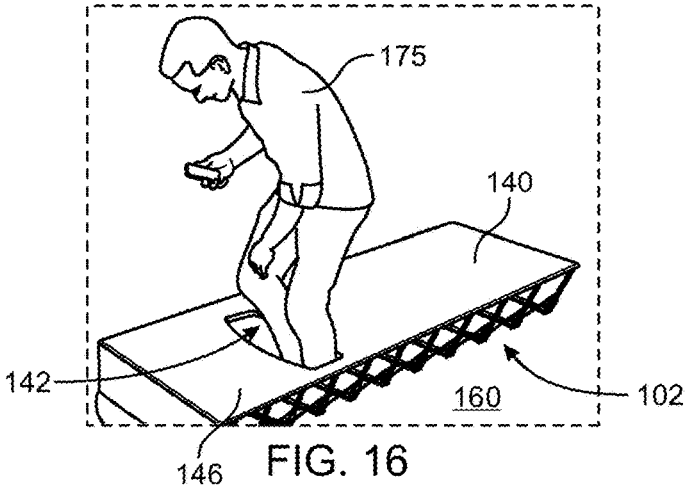
FIG. 16 is a view illustrating another example transportation hub use case for the device in its expanded open state showing the flap compartment open.
Figure 17:
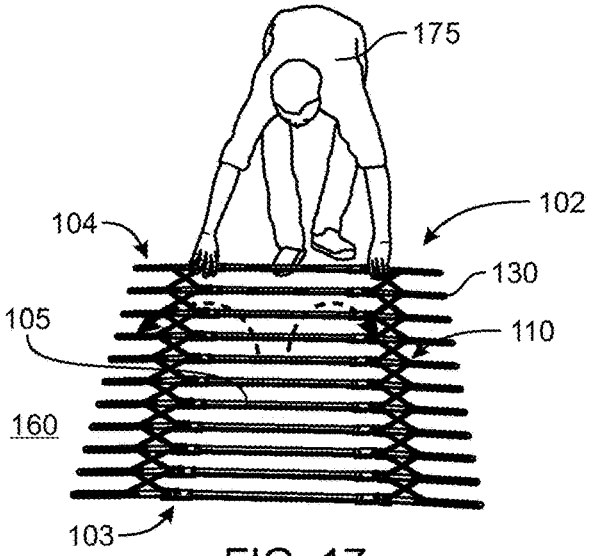
FIG. 17 is a view illustrating one step in a method of closing the device from the expanded open state to the compact closed state according to the example embodiments.
Figure 18:
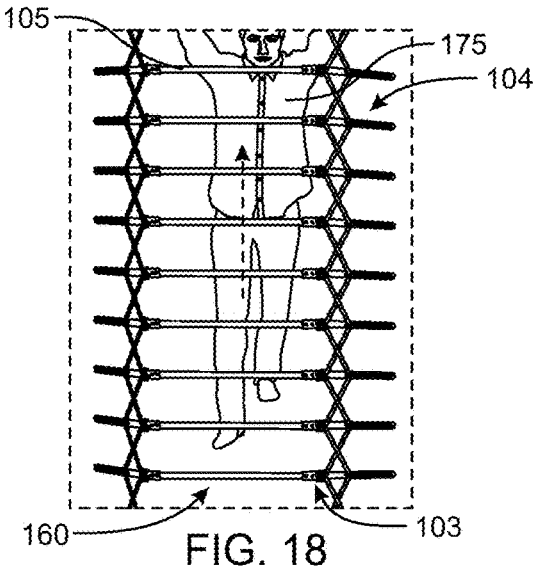
FIG. 18 is a view illustrating another step in the method of closing the device.
Figure 19:
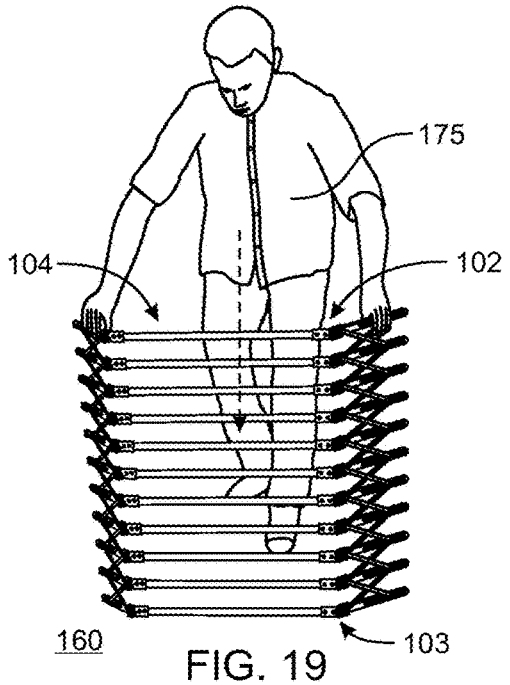
FIG. 19 is a view illustrating yet another step in the method of closing the device.

FIGS. 12 through 14 are views illustrating steps in a method of opening the device from the compact closed state to the expanded open state according to the example embodiments. In this method of operation to open, and referring to FIG. 12 a first end 103 is placed on a group surface 160 and oriented vertically, with the second end 104 grabbed by the person (hereafter "user") 175. The user grabs the slide arms 130 and connected scissor arm sets 110 and begins rotating outward and away (recall FIGS. 6 and 7, relative to the support bars 105) until the support arms 130 reach obtuse angle α at the limit stop location 126 (FIG. 7). Then, the user lifts end 104 vertically upward (FIG. 13) with end 103 anchored on the ground, expanding frame 102 of device 100 via the scissor arm sets 110. Next, the user 175 may step backward, with frame 102 still anchored at end 103 on ground surface 160, the continue laterally expanding frame 102 of device 100 to its fully expanded open state, thus laying out the expanded frame 102 onto the ground surface 160. The material support cover 140 may then be attached to the frame 102 (such as is shown in the use cases of FIG. 15 or 16), to the upper ends of the pivotable arms 130. The material support cover 140 thus forms the top of the device 100 and is adapted to provide a support surface above ground level for the device 100.

Conversely, FIGS. 17 through 21 are views illustrating steps in a method of closing the device from the expanded open state to the compact closed state according to the example embodiments. To collapse device 100, (here support cover 140 is removable and has been removed in advance; note that it could be fixed to frame 102), user 175 grabs device 100 at end 104 (FIG. 170, using end 103 as a rotation moment against ground surface 160. Before doing this, user 175 has partially rotated the slide arms 130 (see dotted-line arrows) so that slider arms 130 and scissor arm set 110 rest flat on ground surface 160.

Figure 20:
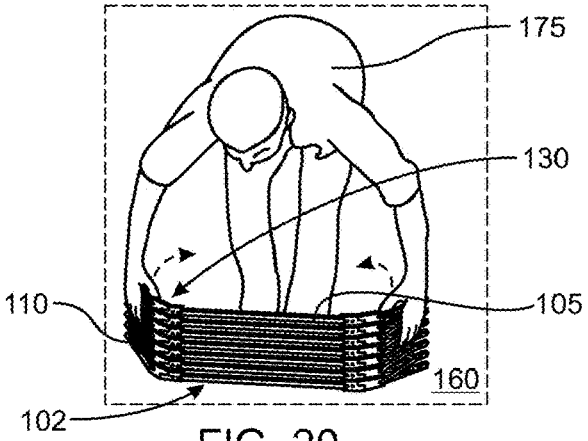
FIG. 20 is a view illustrating a further step in the method of closing the device.
Figure 21:
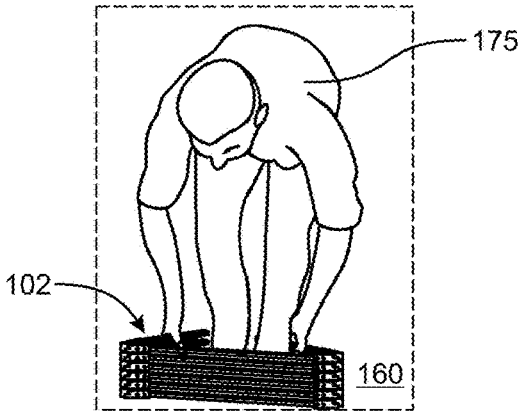
FIG. 21 is a view illustrating yet a further step in the method of closing the device rotating the slider arms from their obtuse angle state inward to the closed state.

User 175 then lifts the frame 102 up vertically from end 104 (FIG. 18), and then immediately drops the frame 102 (FIG. 19) with the aid of gravity toward the ground surface 160 so that the slide arms 130 and connected sets of scissor arms 110 and support bars 105 collapse (see FIG. 20). Finally, user 175 completes the evolution by continuing to rotate the slider arms 130 inward toward each other (FIG. 21) so they lay directly adjacent to one another and between the collapsed support bars 105 and collapsed scissor arm sets 110 (recall FIGS. 3 and 4) so as to realize the compact closed state of the device 100.

Figure 22:
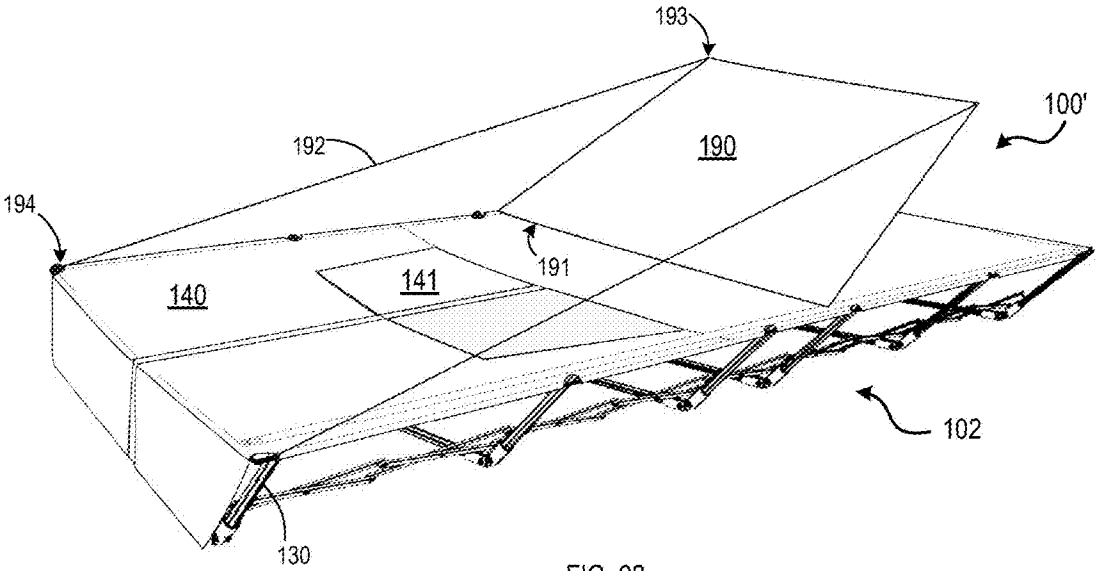
FIG. 22 is a perspective view of an expandable and collapsible support device in a lounge chair configuration, according to another example embodiment.
Figure 23:
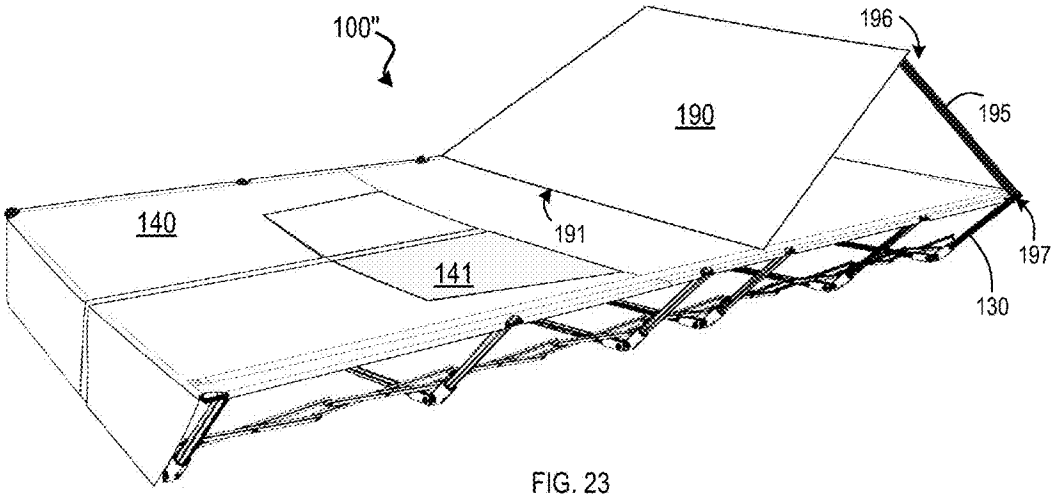
FIG. 23 is a perspective view of an expandable and collapsible support device in a lounge chair configuration, according to another example embodiment.

FIGS. 22 and 23 are perspective views of an expandable and collapsible support device in various lounge chair configurations, according to another example embodiment. In FIG. 22, an additional semi-rigid sheet 190 may be sewn into or otherwise attached to support cover 140 at seam 191. Here, a pair of anchoring lines 192, or cords, etc., may be anchored at points 193 and 194 to support the weight of the user's upper abdomen/back on top of frame 102. FIG. 23 is similar, but here sheet 190 is support by rods or poles 195 secured between anchoring points 196 and 197. Various fastening mechanisms may be employed to secure anchoring lines 192 or poles 195 between the sheet 190 and fame 102.

Figure 24:
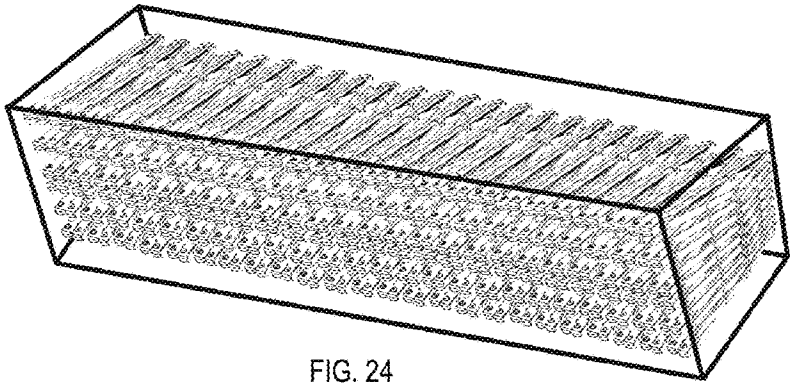
FIG. 24 is a perspective view of a plurality of devices arranged in stackable relation within a container, according to an example embodiment.
Figure 26:
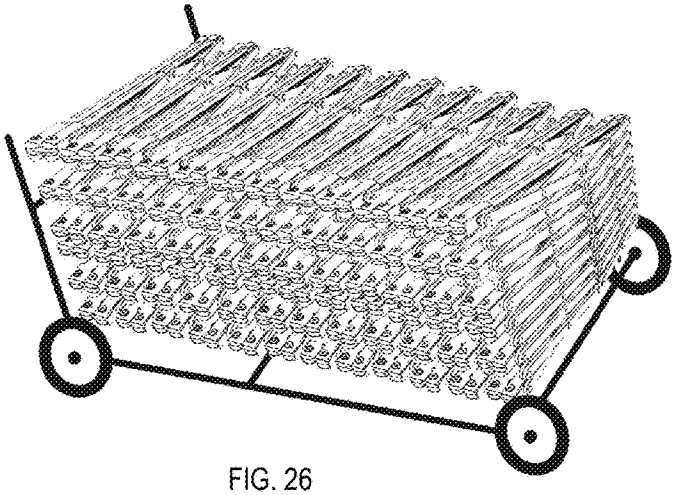
FIG. 26 is a perspective view of a plurality of devices arranged in stackable relation on a four-wheeled cart, according to an example embodiment.
Figure 25:
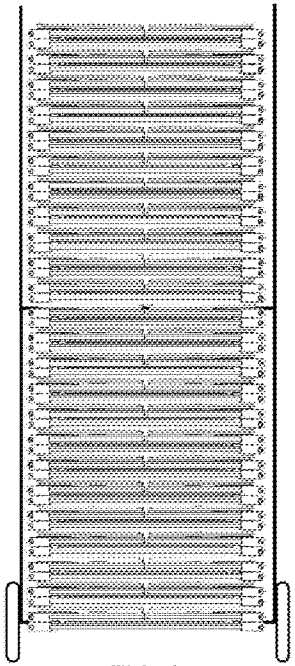
FIG. 25 is a perspective view of a plurality of devices arranged in stackable relation on a hand cart, according to an example embodiment.

FIGS. 24 through 26 are various views of a plurality of the devices 100 arranged in stackable relation within a container, on a hand cart, and on a four-wheeled cart, according to an example embodiment. The compactness of device 100 lends it great flexibility when it comes to transport. Hundreds if not thousands of devices 100 can be easily transported via air, rail and sea as is evident from FIGS. 24-26, such as for use in military operations, in disaster relief operations, concerts, temporary sleeping facilities for mass groups of people, and the like.

The example embodiments having been described, it is apparent that such have many varied applications. For example, the example embodiments may be applicable but not limited to connection to various devices, structures and articles.

The present invention, in its various embodiments, configurations, and aspects, includes components, systems and/or apparatuses substantially as depicted and described herein, including various embodiments, sub-combinations, and subsets thereof. Those of skill in the art will understand how to make and use the present invention after understanding the present disclosure. The present invention, in its various embodiments, configurations, and aspects, includes providing devices in the absence of items not depicted and/or described herein or in various embodiments, configurations, or aspects hereof, including in the absence of such items as may have been used in previous devices, e.g., for improving performance, achieving ease and/or reducing cost of implementation.

The foregoing discussion of the invention has been presented for purposes of illustration and description. The foregoing is not intended to limit the invention to the form or forms disclosed herein. In the foregoing Detailed Description for example, various features of the invention are grouped together in one or more embodiments, configurations, or aspects for the purpose of streamlining the disclosure. The features of the embodiments, configurations, or aspects of the invention may be combined in alternate embodiments, configurations, or aspects other than those discussed above. This method of disclosure is not to be interpreted as reflecting an intention that the claimed invention requires more features than are expressly recited in each claim. Rather, as the following claims reflect, inventive aspects lie in less than all features of a single foregoing disclosed embodiment, configuration, or aspect. Thus, the following claims are hereby incorporated into this Detailed Description, with each claim standing on its own as a separate preferred embodiment of the invention.

Moreover, though the description of the invention has included description of one or more embodiments, configurations, or aspects and certain variations and modifications, other variations, combinations, and modifications are within the scope of the invention, e.g., as may be within the skill and knowledge of those in the art, after understanding the present disclosure. It is intended to obtain rights which include alternative embodiments, configurations, or aspects to the extent permitted, including alternate, interchangeable and/or equivalent structures to those claimed, whether or not such alternate, interchangeable and/or equivalent structures disclosed herein, and without intending to publicly dedicate any patentable subject matter.

We claim:

1. An expandable and collapsible support device, comprising:

an accordion-style frame that expands laterally from a compact closed state to an expanded open state, the frame further including:

a plurality of support bars adapted to support the device, in the expanded open state, on a ground surface in adjacent relation to one another and arranged in a width-wise direction of the device, the support bars laterally extendible and collapsible along a lengthwise plane of the device, a plurality of slider arms in adjacent relation to one another and extendible and collapsible along the lengthwise plane on either side of the device, two sets of scissor arms, each scissor arm set connected across the slider arms and arranged on either lengthwise side of the device, each scissor arm set laterally extensible and collapsible along the lengthwise plane of the device, and a hinge assembly connecting ends of each support bar to a corresponding slider arm to enable pivoting of each slider arm relative to its connected support bar, in going from the compact closed state toward the expanded open state, so that in the expanded open state the slider arm is at an obtuse angle relative to its corresponding support bar, and to enable pivoting of the slider arms inward towards the support bars as the frame is collapsed back into its compact closed state, and a material support cover to provide a support surface above ground level for the device.

2. The device of claim 1, further comprising a closeable flap attachment that when open provides a central compartment in the support cover of the device, the central compartment configurable to place a person's legs therein, to place personal articles therein for access therethrough by the person as the person is supported on the device, and to permit access to power cords attached to remote power sources for powering the person's electronic devices.

3. The device of claim 1, the device further configurable as one or both of a cot and a lounge chair.

4. The device of claim 1, wherein the support cover of the device is with the device in its expanded open state is further configurable as a camouflage bullet-proof shield for military and law enforcement use.

5. The device of claim 1, wherein no dimension of the device in its compact closed state exceeds 21 inches in length.

6. The device of claim 1, wherein the device in a fully-expanded open state is configurable to exceed 3 feet in length.

7. The device of claim 1, further comprising a hinge assembly contained partially within a support bar collar attached to each support bar and partially within a slider collar attached to an end of each slider arm, wherein the hinge assembly further includes:

a first dowel extending transverse through a distal end of the support bar collar, an outer surface of the support bar collar having a curved or beveled surface, a second dowel extending transverse through a distal end of the slider collar, an outer surface of the slider collar having a curved or beveled surface, a linking element attaching the first and second dowels together, wherein the linking element and beveled surfaces provide a pivot movement about which each slider arm is pivotable relative to the support bar as the device transitions from the compact closed state to the expanded open state so as to reach the obtuse angle and vice versa to the compact closed state, and a limit stop location that prevents further rotation, toward the expanded open state, of the slider arm relative to the support bar.

8. The device of claim 1, wherein the material support cover is of multi-piece construction that is fixedly or removably attachable to the upper ends of the slider arms.

9. The device of claim 1, wherein the material support cover is of one piece construction that is removably attachable over the upper ends of the slider arms and secured beneath the support bars.

10. The device of claim 1, wherein each scissor arm set is extendable and collapsible in a plane that is perpendicular to both the support bars and slider arms, each scissor arm set connected at multiple points to each of the corresponding slider arms on its respective lengthwise side of the device.

* * * * *